US005805188A

United States Patent [19]

Nakajima et al.

[11] Patent Number: 5,805,188

[45] Date of Patent: Sep. 8, 1998

[54] CHAMBERED LIQUID CONTAINER WITH ABSORBING MATERIAL AND RECORDING HEAD AND APPARATUS USING SAME

[75] Inventors: Kazuhiro Nakajima; Yasuo Kotaki, both of Yokohama, Japan

[73] Assignee: Canon Kabushiki Kaisha, Tokyo, Japan

[21] Appl. No.: 974,706

[22] Filed: Nov. 12, 1992

[30] Foreign Application Priority Data

Nov. 12, 1991 [JP] Japan ..... 3-323906

[51] Int. Cl.[6] ..... B41J 2/175

[52] U.S. Cl. ..... 347/87; 347/85

[58] Field of Search ..... 346/140 R; 347/85, 347/86, 87

[56] References Cited

U.S. PATENT DOCUMENTS

| | | | |
|---|---|---|---|
| 4,306,245 | 12/1981 | Kasugayama | 346/140 R |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Avata et al. | 346/1.1 |
| 4,558,333 | 12/1985 | Sugitani et al. | 346/140 R |
| 4,631,558 | 12/1986 | Hara | 346/140 R |
| 4,723,129 | 2/1988 | Endo et al. | 346/1.1 |
| 4,740,796 | 4/1988 | Endo et al. | 346/1.1 |
| 4,794,409 | 12/1988 | Cowger et al. | 346/140 R |
| 4,920,362 | 4/1990 | Cowger | 346/140 R |
| 5,102,251 | 4/1992 | Kaufmann | 401/151 |
| 5,430,471 | 7/1995 | Nakajima et al. | 347/87 |

FOREIGN PATENT DOCUMENTS

| | | |
|---|---|---|
| 21341 | 4/1993 | Australia . |
| 0393320 | 10/1990 | European Pat. Off. . |
| 0488829 | 6/1992 | European Pat. Off. . |
| 4007591 | 9/1991 | Germany . |
| 57-159502 | 10/1982 | Japan . |
| 59-123670 | 7/1984 | Japan . |
| 59-138461 | 8/1984 | Japan . |

*Primary Examiner*—Valerie Lund

*Attorney, Agent, or Firm*—Fitzpatrick, Cella, Harper & Scinto

[57] ABSTRACT

A liquid container for containing liquid includes a plurality of defined chambers, a liquid supply port for supplying the liquid from the container, the supply port being formed in one of the chambers, an air vent formed in the one of the chambers, and a porous liquid supply material only through which the chambers communicate.

19 Claims, 12 Drawing Sheets

CHAMBERED LIQUID CONTAINER WITH ABSORBING MATERIAL AND RECORDING HEAD AND APPARATUS USING SAME

FIELD OF THE INVENTION AND RELATED ART

The present invention relates to a liquid container which permits a required quantity to be taken out therefrom on demand and which is usable in a writing device, a container for containing oil, gasoline or the like or an ink containing device usable in various recording fields, to a recording head unit using the same and a recording apparatus using the same.

In a liquid container used for containing ink, flammable liquid, chemical material or the like, it is desired that the liquid is supplied from the container through a supply port of the container in the amount matching the amount taken out therefrom and also that the liquid does not leak-out of the container when the liquid is not supplied out of the container. The desire is particularly significant in the case of an ink container for an ink jet recording system in which the recording is effected with the ejection of the ink from a recording head, particularly from the standpoint of the influence to the image quality related to the ink supply amount.

In an attempt to meet the desire, the following proposals have been made.

Referring first to FIG. 15, an ink container of an ink cartridge 301 is filled substantially entirely with a porous material 303 which retains the ink. Adjacent one end of the porous material 303, there is provided an ink supply port 306, which is in communication with a recording head 305 through a supply pipe, and adjacent the other end, there is provided an air vent 304.

In this ink container, a vacuum in the ink container is maintained by the capillary force provided by the porous material 303, so that the ink does not leak out through the ink supply port 306.

However, since the ink is retained in the porous material, the amount of the ink contained in the cartridge or the ink container is small, and in addition, the amount of non-usable ink is also large.

In order to remove the reduction of the volume efficiency due to the use of the porous material in the container, the following ink containers not using the porous material are known.

FIG. 16 shows examples of such a structure. In FIG. 16 which is disclosed in U.S. Pat. No. 4,794,409, a liquid container is used for an ink jet recording head unit and an ink container 401, an overflow sump 404 and the recording head 405 communicate through a porous material 403. In this case, the liquid containing portion 401 does not include the porous material, so the volume efficiency can be increased. The containing portion 401 constitutes a closed space with the exception of a hole 406, through which the liquid is replaced with air with consumption of the liquid, so that the vacuum in the container is maintained to retain the liquid in the container.

In addition, the ink containers have to be provided with the overflow sump having such a capacity as can guarantee the possible worst ambient conditions, in order to assure the safe use even if the air in the ink chamber expands due to the change of the pressure, temperature or the like.

In the example shown in FIG. 16, the ink leakage from the print head due to the temperature change in the abovediscussed mechanism, can be prevented to a certain extent. However, if the capacity of the sump is small as compared with the capacity of the ink container, the ink from the ink container cannot be accommodated with the result of leakage of the ink from the sump. In other words, there is a problem that if the capacity ratio between the ink container capacity and the sump capacity is not properly determined, the ink leakage will occur upon increase of the internal pressure due to the temperature change or the like. In addition, one limitation of this container during use is significant. If the print head is directed downwardly during use thereof, there is no problem. If, however, the print head is positioned horizontally with the rest of the ink less than the half, the ink supply is prevented due to the position of the hole 406, and therefore, the position with which the ink can be efficiently used is limited.

U.S. Pat. No. 4,920,362 proposes a solution to the problem of the relation between capacities of the ink container and the sump.

This is shown in FIG. 14, the ink container 201 is divided into three chambers 206, 207 and 208 by two partition walls 202*a* and 202*b*. The chambers 206, 207 and 208 communicate with each other through small diameter orifices 203*a* and 203*b* formed in the partition walls 202*a* and 202*b*. The bottom of the first chamber 206 communicates with an ink well 209 for supplying the ink to an ink droplet producer 205. The bottom of the third chamber 208 communicates with an overflow sump 211 communicating with the external air through a vent 204 through a drop pipe 210 and bubble creating orifice 203*c* thereof.

In this ink jet pen, the ink corresponding to the ink amount consumed from the ink droplet producer 205, is supplied to the first chamber 206 from the second chamber 207 through the orifice 203*a*. To the second chamber 207, the ink is supplied from the third chamber 208 through the orifice 203*b*. As a result, the internal pressure of the third chamber 208 decreases. When the internal pressure reaches a threshold level, the air is supplied to the third chamber 208 through the bubble producing orifice 203*c*, and therefore, the internal pressure of the third chamber 208 is automatically controlled, by which the internal pressures of the second and first chambers 207 and 206, are controlled. When, on the other hand, the internal pressure of the ink sump 211 increases due to the ambient condition change, the ink flows into the overflow sump 211 through the ink droplet pipe 210, and therefore, the ink does not leak out from the ink droplet producer 205. Since the ink is consumed from the chambers 208, 207 and 206 in the order named, the chamber influenced by the ambient condition is substantially only one of the chambers 206, 207 and 208. For this reason, the amount of the overflow ink can be decreased, so that the capacity of the overflow sump can be reduced, thus increasing the volume efficiency of the entire container.

In the structure of FIG. 14, the plural ink chambers communicate with each other through such small size orifices as produce capillary force, and therefore, there is a liability that clogging occurs if the ink contains foreign matter or precipitates. The small diameter orifices have to have such a configuration that the ink does not leak out through the outlet, that both of the air and the ink do not flow simultaneously therethrough and that the efficient ink supply is not impeded. Therefore, it involves manufacturing difficulty.

In the liquid container shown in FIG. 14, the vacuum of the ink container 201 is maintained by small size orifices 203*a* and 203*b*. In a certain stage of use, the ink chamber 208 is filled with air, and a part of the ink chamber 207 is already used with a certain volume of the air existing in the ink chamber. If the ink container is then so inclined that the air in the ink chamber 207 and the air in the ink chamber 208 communicate with each other through the small chamber orifice 203*b* the ink in the ink chamber 207 is, in effect, directly open to the ambient air with the result of incapability of maintaining the negative pressure. Then, the ink leaks more easily through the recording head 205.

SUMMARY OF THE INVENTION

Accordingly, it is a principal object of the present invention to provide a liquid container, a recording head unit using the same and a recording apparatus using the same in which the liquid can be stably supplied to the outside of the container.

It is another object of the present invention to provide a liquid container, a recording head unit using the same and a recording apparatus using the same in which the ink does not leak out irrespective of the ambient condition change or the orientation during use.

It is a further object of the present invention to provide a liquid container, a recording head unit using the same and a recording apparatus using the same in which the latitude of pose of the container during use is large.

It is a yet further object of the present invention to provide a liquid container, a recording head unit and a recording apparatus in which a volume efficiency of the container is large.

It is a yet further object of the present invention to provide a liquid container, a recording head unit using the same and a recording apparatus using the same in which the manufacturing cost and manufacturing difficulty of the container is low.

According to an aspect of the present invention, there is provided a liquid container for containing liquid, comprising: a plurality of defined chambers; a liquid supply port for supplying the liquid out of said container, said supply port is formed in one of said chambers; an air vent formed in said one of the chambers; and liquid supply material only through which said chambers communicate.

According to another aspect of the present invention, there is provided a recording head unit comprising: a liquid container including a plurality of defined chambers; a liquid supply port for supplying the liquid out of said container, said supply port is formed in one of said chambers; an air vent formed in said one of the chambers; and liquid supply material only through which said chambers communicate; and a recording head having energy generating means for generating energy to eject the liquid supplied thereto from the liquid supply port.

According to a further aspect of the present invention, there is provide a recording apparatus comprising: a liquid container including a plurality of defined chambers; a liquid supply port for supplying the liquid out of said container, said supply port is formed in one of said chambers; an air vent formed in said one of the chambers; and liquid supply material only through which said chambers communicate; a recording head having energy generating means for generating energy to eject the liquid supplied thereto from the liquid supply port; and electric energy supply means for supplying electric energy to generate the energy.

These and other objects, features and advantages of the present invention will become more apparent upon a consideration of the following description of the preferred embodiments of the present invention taken in conjunction with the accompanying drawings.

The liquid container according to an embodiment of the present invention, plural chambers communicating each other by way of a porous material, and therefore, there occurs no clogging with the foreign matter or the like. A porous material is also disposed at the discharger outlet, and therefore, the vacuum of the container is properly controlled by the capillary force of the porous material. This permits stabilized retention and supply of the liquid.

When the liquid container is used as an ink container for a recording head or a recording apparatus, the ink can be stably supplied out, this accomplishing stabilized high quality recording.

DESCRIPTION OF THE PREFERRED EMBODIMENTS

Referring to the accompanying drawings, the embodiments of the present invention will be described.

Figure 1:
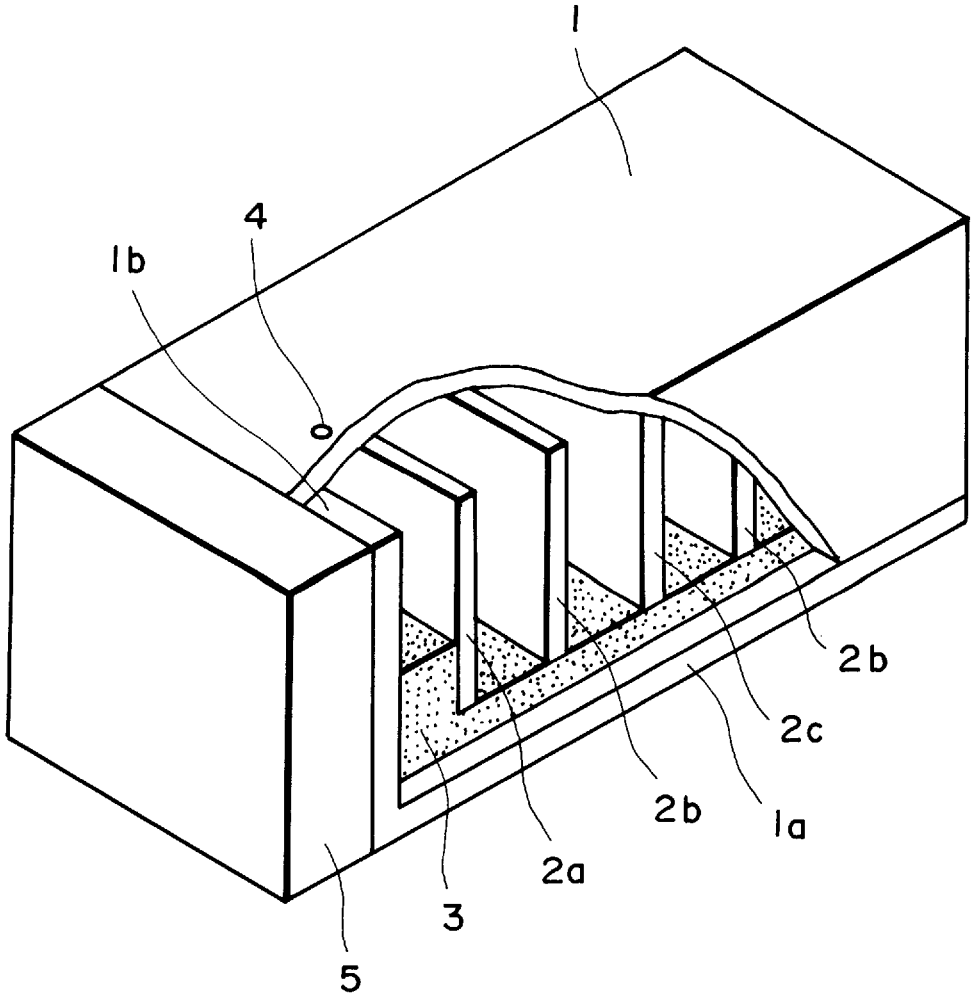
FIG. 1 is a partly exploded perspective view of a liquid container according to an embodiment of the present invention.
Figure 2:
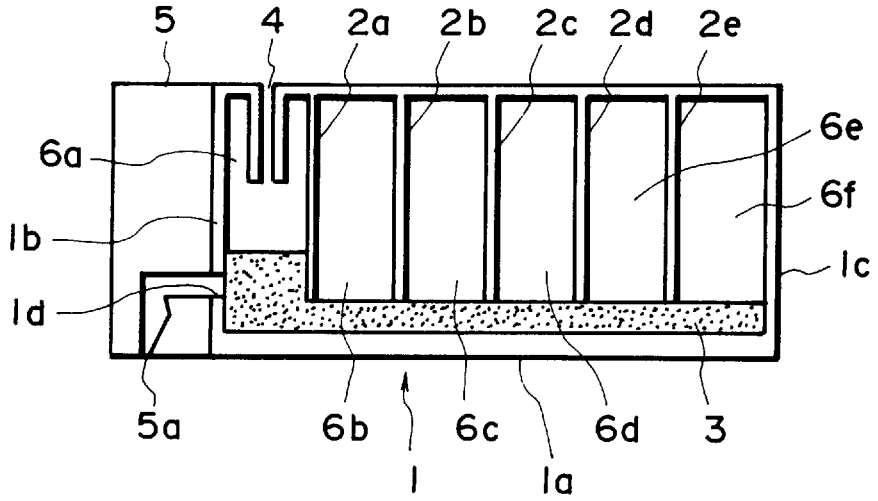
FIG. 2 is a sectional view of a liquid container according to the embodiment of the present invention.

FIG. 1 is a partly broken perspective view of an ink container according to an embodiment of the present invention. FIG. 2 is a longitudinal sectional view of the same ink container. In this embodiment, the liquid container is in the form of an ink container.

In this embodiment, the ink container is used with a recording head which ejects the ink to a recording material such as a sheet of paper. However, the recording head 5 may be a separate member which is mountable to the liquid container.

As shown in FIGS. 1 and 2, the main body 1 of the container is provided with liquid supply material 3 made of porous material (such as sponge or the like) or fibrous material. The portion other than the liquid supply material 3 is divided into six chambers 6*a*, 6*b*, 6*c*, 6*d*, 6*e* and 6*f* by partition plates 2*a*, 2*b*, 2*c*, 2*d* and 2*e* which are formed integrally or separately with the main body 1. If the material of the container body 1 is a transparent material or the like, the remaining amount of the ink can be known. The adjacent chambers are in flow communication only through the liquid supply material 3.

The recording head 5 is mounted on an outer surface of the front wall 1*b* having the supply port 1*d* of the container body and is supplied with ink through the supply port 1*d*. The spaces in the first chamber 6*a* which is an end chamber communicates with the ambience through an air vent 4. When the recording head 5 is mounted in the recording apparatus, the supply port id permits ink supply from the liquid supply material to the recording head 5.

The first chamber 6*a* which is an end chamber of the container body includes a liquid supply material 3 extending to the neighborhood of the supply port 1*d* except for the above-mentioned space and the supply port 1*d* for dispersing the ink, and includes the air vent 4 opened to the space. The plural chambers communicate by the extension of the liquid supply material.

The air vent 4 is in the form of a tube extending to the middle of the space of the first chamber. Therefore, even if the ink is contained in the first chamber 6*a* having the air vent 4, the ink does not leak out irrespective of the orientation of the ink container unless the volume of the ink exceeds half the volume of the first chamber 6*a*.

Referring to FIG. 4, the ink container during the recording operation will be described.

The permissible orientation of the ink container during the recording operation is satisfied, as shown in FIG. 4, when at least a part of the liquid supply material 3 is disposed at the bottom of the ink container. Therefore, the positional latitude is large.

Figure 4A:
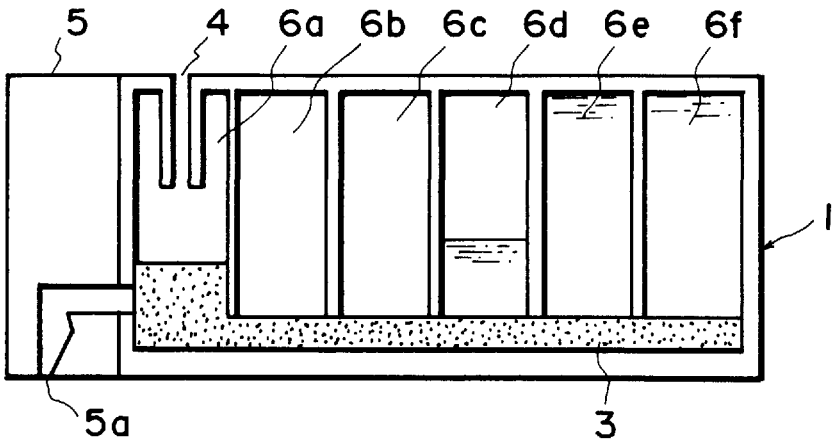
FIGS. 4A, 4B and 4C are sectional views illustrating consumption of the liquid therein.

At the initial stage, all of the chambers of the ink container except for the first chamber 6*a* having the air vent 4, are filled with the ink. With the printing operation, the ink is consumed from the chamber closest to the first chamber 6*a*, as shown in FIG. 4A.

The reason for this is as follows. With the discharge of the ink through the discharge outlet 1*d* and ejection outlets 5*a*, the corresponding amount of the ink is sucked through the liquid supply material 3 out of the fourth chamber 6*d* closest to the first chamber 6*a*. Similarly, the ink is sequentially supplied from the upstream chamber, so that the ink is supplied continuously to the ejection outlets 5*a*. Then, a space having a volume corresponding to the consumed ink is formed by the air supplied through the air vent and through the liquid supply material 3. Thus, the ink is supplied from the chambers closer to the first chamber, sequentially. Since the liquid supply member extending to the supply port connects with the recording head 5 and since the chambers are connected by the extension of the liquid supply member, the vacuum of ink in the container is maintained by the many fine meniscuses in the liquid supply member.

The description will be made as to retention of the ink when the printing operation is not carried out. With variation of the ambience condition, particularly the ambient temperature or pressure, the air volume changes greatly, althrough the volume of the ink (liquid) hardly changes. If the temperature increases in the state shown in FIG. 4A, the air in the fourth chamber 6*d* expands to discharge the ink in the fourth chamber to the third chamber 6*c*, since the air in the fourth chamber 6*d* does not communicate the ambient air. However, the ink discharged to the third chamber 6*c* expands toward the first chamber 6*a* through the liquid supply material 3. During the expansion the air in the third chamber 6*c* and the air in the second chamber 6*b* are disconnected from the external air. As a result, even if the air in the fourth chamber 6*d* expands so as to discharge the ink to the third chamber 6*c*, the discharge ink hardly enters the third chamber 6*c* or the second chamber 6*b*, as shown in FIG. 4B, but enters only the first chamber 6*a* having the air vent 4.

As will be understood from the foregoing, the volume of the ink overflowing into the first chamber 6*a* is determined only by the volume of the ink in the chamber (6*d*, for example) or chambers that contain both the ink and the air therein prior to the temperature rise. In view of this, the volume of the first chamber 6*a* is determined such that it has a proper ratio relative to the ink volume in the second 6*b* and subsequent chambers that contain both the air and the ink, in consideration of the variation ranges of the temperature and pressure.

Figure 4B:
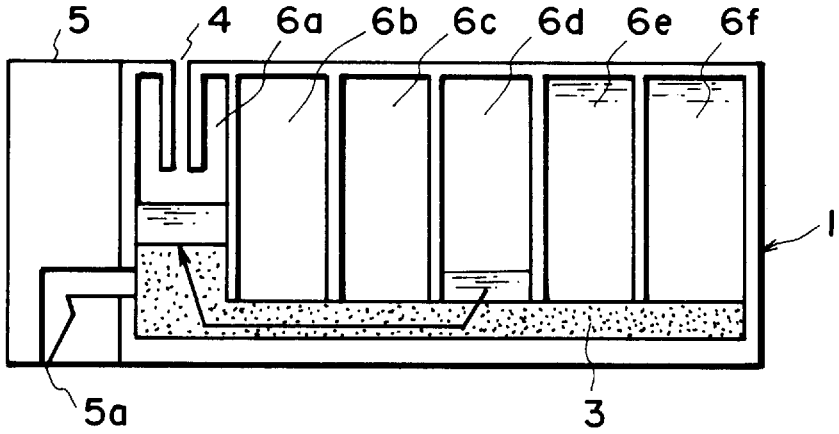
Figure 4C:
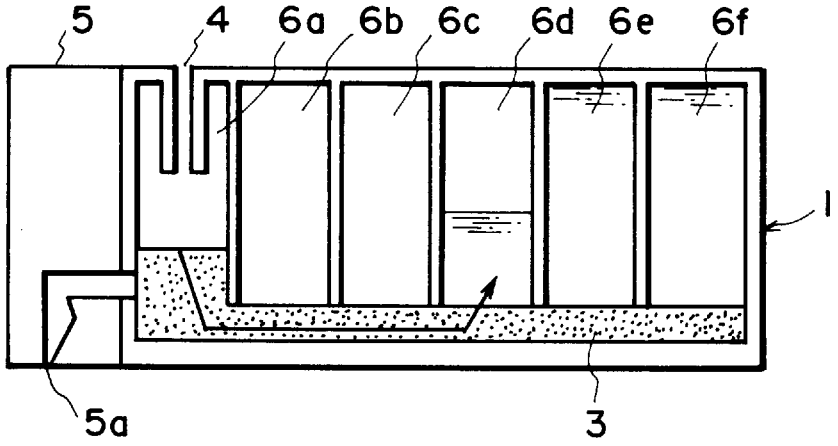

When the temperature decreases in the state shown in FIG. 4B, the ink having moved to the first chamber 6*a* is sucked back into the second, third and fourth chambers 6*b*–6*d* with the contraction of the air, since the air in the second, third and fourth chambers 6*b*–6*d* are disconnected from the external air. Finally, the initial state shown in FIG. 4C is reached.

The above-described ink retention during non-printing functions irrespective of the position of the ink. If, however, the liquid supply material 3 in FIGS. 4A, 4B and 4C is upside down, even the overflowing to the first chamber 6*a* does not occur despite temperature rise since all the air in the container communicate with the external air without movement of the ink.

As described in the foregoing, according to this embodiment, a chamber having a supply port for supplying the liquid out and a chamber in flow communication with ambience, is in flow communication only with the liquid supply material. For this reason, even if the ambient condition such as temperature or pressure or the like changes, the ink can be sufficiently supplied to the supply port without the liability of ink leakage. In addition, the latitude of the orientation of the ink container is large under the condition that the ink moved to the chamber in flow communication with the ambience due to the external ambient condition can restore to the original state.

The liquid supply material in this embodiment will suffice if it is stable relative to the liquid contained in the container, and if it is capable of retaining the liquid by the meniscuses formed therein and if it is capable of coupling the adjacent chambers for liquid and air communication. Examples of the material include a porous material such as sponge and fibrous material such as felt. From the standpoint of use efficiency of the ink, the porous material is preferable. The liquid supply material is preferably continuous for flow communication between the chamber in communication with the outside air and the chamber provided with the supply port. However, it is not necessarily formed integrally, and from the convenience in the manufacturing thereof, plural liquid supply materials connected are usable.

The partition plates 2*a*–2*e* may be separate members from the main body of container, but the hermetical sealing is desirably established to prevent the flow communication between adjacent chambers except through the liquid supply material 3. In this embodiment, the number of chambers is six, but the number is not limited if the same chamber does not have both of the air vent and the supply port. In order to reduce the amount of the liquid flowing back toward the upstream chamber due to the ambient condition change, the provision of a larger number of chambers is desirable. From the standpoint of the stabilized supply of the liquid, the plural chambers are connected in series by the liquid supply material.

In this embodiment, the use of plural chambers permits consumption of the ink sequentially from the chamber having the air vent. Therefore, if at least a part of the container is made of transparent or semi-transparent material, the ink in the container can be observed to be aware of the remaining amount of the ink.

Figure 3:
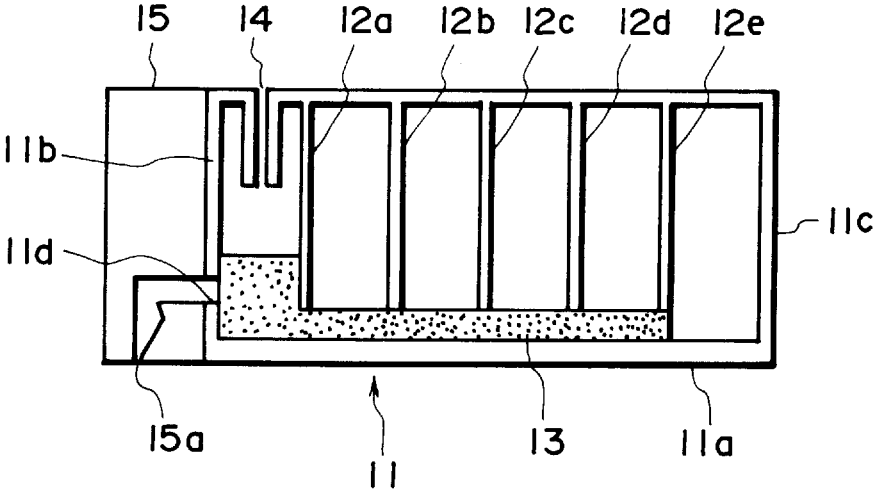
FIG. 3 is a sectional view of a liquid container according to another embodiment of the present invention.

FIG. 3 is a schematic sectional view of an ink container according to a second embodiment of the present invention. In this embodiment, a liquid supply member 13 extends to between an open end of a fifth partition plate 12*e* and a bottom wall 11*a* of the container body 11. But, there is no liquid supply member at a position facing the sixth chamber 6*f* of the bottom wall 11*a*. In the other respects, this embodiment is the same as the first embodiment.

The operation of this embodiment is the same as in the first embodiment except that when the container is positioned such that the supply port 11*d* faces upwardly during the printing, the ink remains in the sixth chamber 6*f*. Except for this positioning, the remaining amount of the ink can be reduced as compared with the first embodiment, corresponding to the reduced volume of the liquid supply member 13.

The container may be in the form of an ink container cartridge separable from the recording head. Such embodiments will be described.

Figure 5:
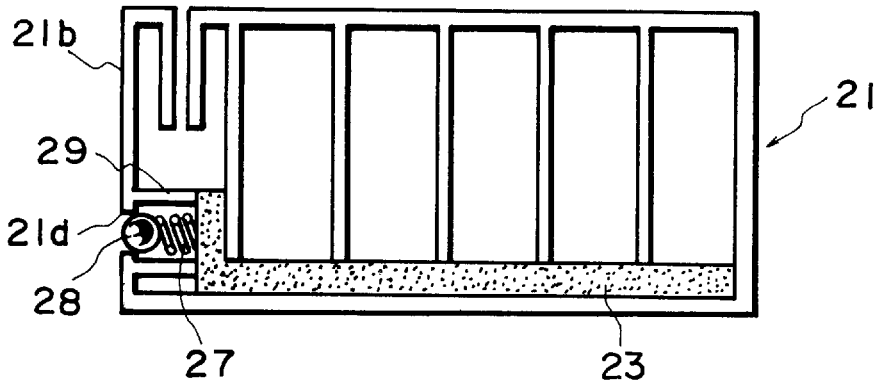
FIG. 5 is a sectional view of a liquid container according to a further embodiment of the present invention.

FIG. 5 is a schematic view of an ink container according to a third embodiment of the present invention. The supply port 21*d* formed in the front wall 21*b* of the container main body 21 is enclosed by a valve guide 29 projected inwardly. An open end of the valve guide 29 is covered with a porous material 23, and the discharge port 21*d* is closed by a ball 28 normally urged to the discharge port 21*d* by a spring 27. The discharge port 21*d* is opened by a part of the recording head to be supplied with the ink from the container, upon container therebetween.

Figure 6:
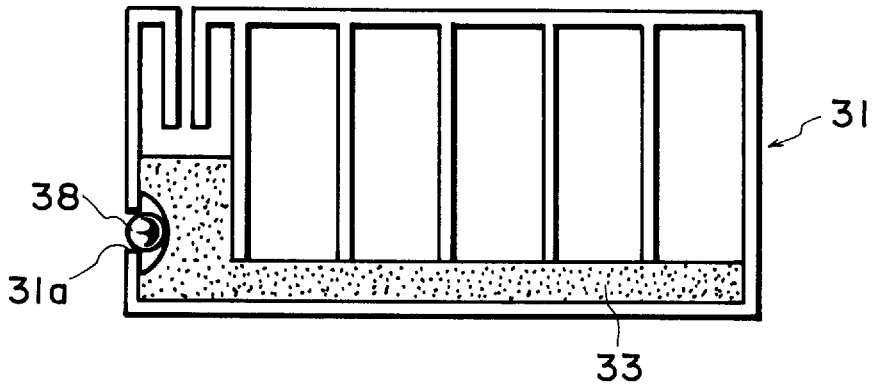
FIG. 6 is a sectional view of a liquid container according to a further embodiment of the present invention.

FIG. 6 shows an ink container according to a fourth embodiment of the present invention. The discharge port 31*d* of the container body 31 is closed by a ball 38 normally urged to the discharge port 31*d* by the liquid supply material 33 disposed adjacent to the discharge port 31*d*.

Figure 7:
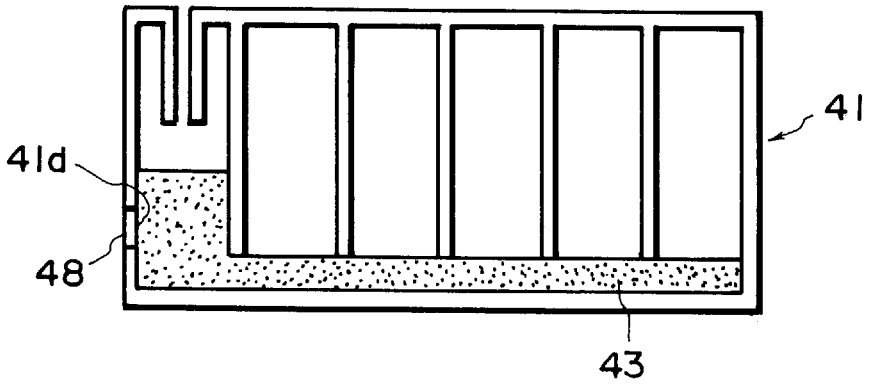
FIG. 7 is a sectional view of a liquid container according to a further embodiment of the present invention.

FIG. 7 shows an ink container according to a fifth embodiment of the present invention. The discharge port 41*d* of the container 41 is closed by a closing sheet 48, which is peeled off or torn by a ink receipt of unshown recording head, upon start of use, the permit the ink supply therefrom.

Referring to FIGS. 8A, 8B, 8C and 8D, 9A, 9B and 9C and 10A, 10B and 10C, the description will be made as to modifications of the position and shape of the porous material.

Figure 8A:
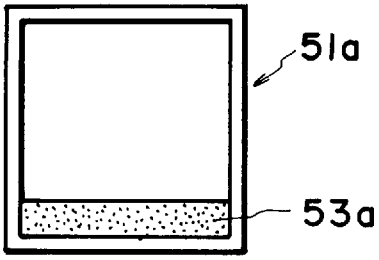
FIGS. 8A, 8B, 8C, and 8D are cross-sectional views of liquid containers illustrating the shape of the liquid supply material and the position thereof in the embodiments of the present invention.

In FIG. 8A, a container body 51*a* has a liquid supply material 53*a* of the same material at the same position as in the foregoing embodiments. This is operable in all positions except for the upside down position in FIG. 8, that is, the position in which the liquid supply material 53*a* is at the top.

Figure 8B:
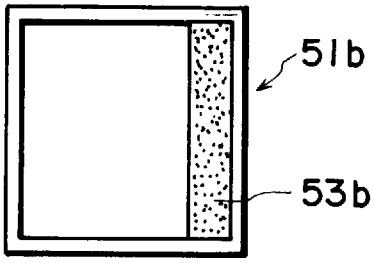

FIG. 8B shows a liquid container body 51*b* having a liquid supply material 53*b* rotated by 90 degrees from FIG. 8A position. This is operable except for the position in which the left side is at the bottom.

Figure 8C:
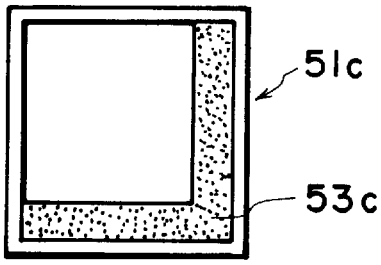

FIG. 8C shows a container body 51*c* having an L-shaped liquid supply material 53*c*. This is operable in any position.

Figure 8D:
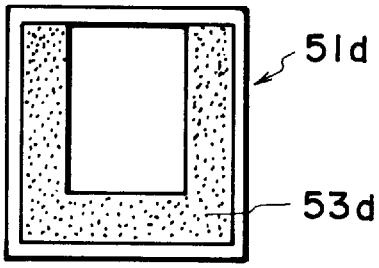

FIG. 8D shows a container body 51*d* having a channel shaped liquid supply material 53*d*. This is operable in any position.

Figure 9A:
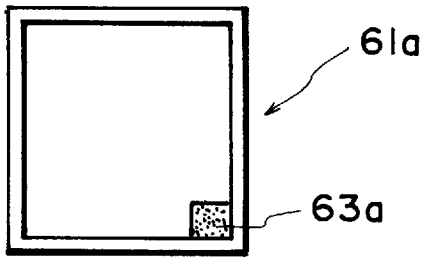
FIGS. 9A, 9B and 9C are cross-sectional views of a container, illustrating the configuration of the liquid supply material and the position thereof.

FIG. 9A shows an example having a rod-like liquid supply material 63*a* at a corner of the container body 61*a*.

Figure 9B:
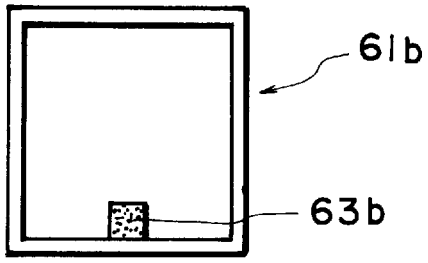

FIG. 9B shows an example having a rod-like liquid supply material 63*b* at a central portion of a wall of the container body 61*b*.

Figure 9C:
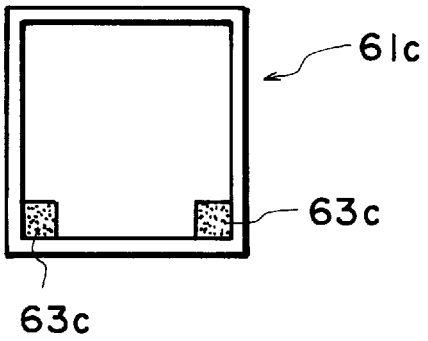

FIG. 9C shows an example having rod-like liquid supply materials 63*c* at two corners of a wall of the container body 61*c*. It is operable in any position.

Figure 10A:
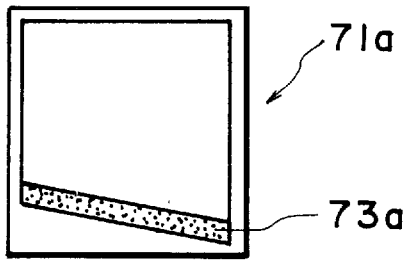
FIGS. 10A, 10B and 10C are cross-sectional views of a container, illustrating the configuration of the liquid supply material and the position thereof.

In FIG. 10A example, a surface indicated as being the bottom surface of the container body 71*a* is inclined, and along the inclined surface, the liquid supply material 73*a* is disposed.

Figure 10B:
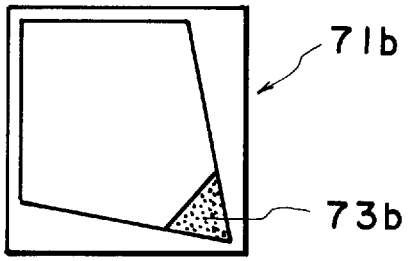

In FIG. 10B, a surface of the container body 71*b* which is indicated as being the bottom surface and the right side surfaces are inclined surfaces, and at the corner, the liquid supply material 73*b* of triangular column shape is disposed.

Figure 10C:
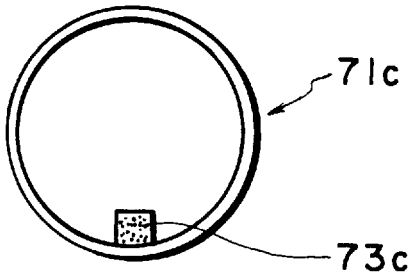

In FIG. 10C, the container body 71*c* is cylindrical, and the liquid supply material 73*c* is disposed on the inside surface thereof.

Figure 11A:
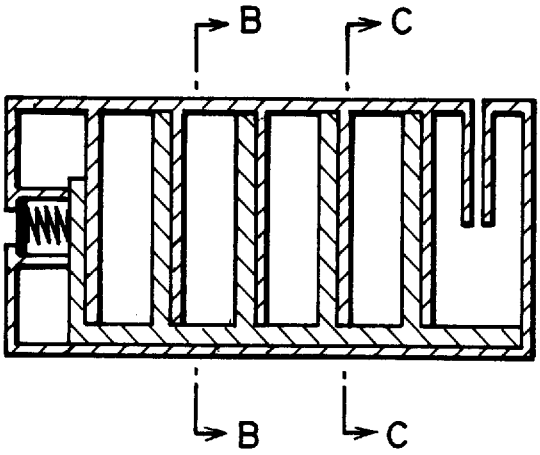
FIG. 11A is a sectional view of a liquid container according to a further embodiment of the present invention.
Figure 11B:
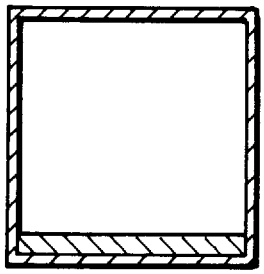
FIG. 11B is a sectional view taken along a line B—B in FIG. 11A.
Figure 11C:
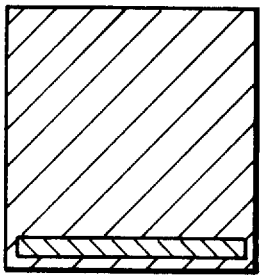
FIG. 11C is a sectional view taken along a line C—C in FIG. 11A.

FIGS. 11A, 11B and 11C show sectional views of an ink container according to a further embodiment of the present invention. In this embodiment, the liquid supply member is extended to the top along each of partition walls. Then, even when the ink container becomes upside-down, the porous material or the fibrous material extended along the partition walls absorbs the ink, and therefore, the ink can be used up.

In the foregoing embodiments, the number of chambers is six. However, the number may be two or more, as described hereinbefore. Since however, the chamber having the air vent 4 does not contain the ink in the initial state, the size of that chamber has to be increased to prevent leakage, if the number of chambers is small, and therefore, the ink capacity is not very large. If the number of chambers is too large, the volume occupied by the partition walls decreases with the result of low ink capacity, again. In consideration of these factors, the number of the chambers is properly determined by one skilled in the art.

The volume of each of the chambers may be any, but it is preferable that the chamber having the air vent has a volume which is not less than 0.6 times the volume of the maximum volume chamber. This is because the ink leakage has to be assuredly prevented even when the air in the container expands or contracts as a result of temperature change or pressure change which possibly occurs under the normal ink container use or handling (the pressure in the cargo chamber is approx. 0.7 atom). In order to provide smooth ink supply, the size of the chambers are preferably uniform or may be increased toward the supply port.

The description will be made as to the liquid supply material used in the ink container of the present invention.

At least portions of the liquid supply material (porous material or fibrous material) which are under the partition walls preferably have substantially isotropic easiness in the ink seeping.

When a part of the flow path of the porous or fibrous material between adjacent chambers becomes above the ink surface because of the position or orientation change of the container, a harmful air flow path may be formed due to an impact to the container. Even if this occurs, the ink is absorbed by capillary action from the existing ink, and therefore, the formed air path will be removed, thus permitting liquid supply again. If the liquid supply material has such a nature that the ink does not easily seep along direction in which the edge contacting the liquid supply material extends, an air path, which is once formed in the liquid supply material above the liquid level by impact or the like, is not easily filled back with the liquid, the liquid is to sufficiently supplied to the supply port, and in addition, the liquid flows out to the chamber having the air vent. If this occurs, the ink may leak out through the vent, when the container is subjected to the temperature or pressure change.

The preferable porous material constituting the liquid supply material 3 is polyurethane foam material. In an example of the producing method of the polyurethane foam material, polyether polyol, polyisocyanate and water are reacted with foaming material, catalyst, coloring agent or additives, if desired, by which a high polymer material having a great number of pores is produced. This is cut into desired size (block), and the block is immersed in the ambience of flammable gas. By explosion of the gas, the film materials between the cells is removed. This producing method is preferable for the material used in this invention.

Table 1 shows results of evaluation of various necessary properties of respective ink containers having the porous material (polyether polyurethane foam) having various porosities.

The ink containers evaluated are those of FIG. 2 embodiment. The porous material continuously extends from the first chamber to the sixth chamber, and is packed between the bottom surfaces of the partition plates 2*a*–2*e* and the bottom surface of the container 1 without clearance therebetween. The packing degree is expressed as a ratio T2/T1 (compression ratio: K), where T1 is a distance between the inside bottom surface 1s of the ink container and the bottom surface of the partition plate 2*a*–2*e*, and T2 is a thickness of the porous material before insertion therebetween. The ratio K larger than 1 means the porous material is compressed between the partition plate and the bottom of the ink container, whereas the ratio smaller than 1 means existence of a gap between the porous material and the partition plate or the bottom surface of the ink container. In the latter case, the problem will arise, as will be described hereinafter.

When the ratio K is 0.8 at the bottom of the partition plate 1*a*, for example, a gap exists between the partition plate 1*a* and the bottom surface of the ink container, and therefore, the-reverse flows of the air and the ink occur, that is, the air flow from the first chamber 6*a* to the second chamber 6*b*, and the ink flow from the second chamber 1b to the first chamber 1*a*. If the ambient condition particularly the temperature rise occurs under this condition, the air expands, and the amount of the ink corresponding to the air expansion moves from the second chamber 1*b* to the first chamber 6*a*. If, however, the first chamber already contains the ink, the first chamber comes to contain a sum of the ink, with the possible result that the sum of the ink amount exceeds the capacity of the first chamber, which leads to the leakage of the ink through the air vent 4.

If, on the other hand, the ratio K is too large, the distribution of the porosity P of the porous material inclines, with the possible result of the ink remaining in the porous material.

The porosity P means a number of cells in 1 inch of the porous material. In the evaluation tests, the compression ratio K was 1.5, while the porosity of the porous material was changed, and the porous materials are evaluated in response of ink supply and durability against vibration. In Table 1, "noncompression" means the portion of the porous material where it is not compressed, and it is seven times as large as the portion which is sandwiched between the partition plate and the bottom plate, as measured in the direction of the ink flow.

(1) Ink supply response

This is indicative of whether proper amount of ink (not too large and not too small) can be supplied to the recording head connected to the ink container during the recording operation. The recording head had 60 nozzles each ejects approx. 100 p1, which was operated at the ejection frequency of 4 kHz. All of the 60 nozzles were actuated (solid image printing). In the evaluation tests, when 10 A4 size sheets were recorded, the evaluation was "GG", and when ejection failure occurs before 10 sheets were completed, the evaluation was "IN".

(2) Vibration durability

The ink container connected with the same recording head was positioned vertically with the recording head at the bottom, and was vibrated at 2 G/10 Hz for 1 hour. When the ink did not leak through the air vent or the nozzle, the evaluation was "G", and when the leakage occurs, the evaluation was "IN".

The air vent was the one directly opening the first chamber 1*a* to the ambience.

TABLE 1

| Test materials | Porosity of non-compressed portion ($inch^{-1}$) | Porosity adjacent discharge port ($inch^{-1}$) | Porosity of portion between walls ($inch^{-1}$) | Property of porous material: Supply responsivity | Property of porous material: Durability |
|---|---|---|---|---|---|
| 1 | 70 | 110 | 105 | G | N |
| 2 | 90 | 110 | 135 | N | N |
| 3 | 90 | 130 | 135 | G | G |
| 4 | 90 | 150 | 135 | G | G |
| 5 | 100 | 150 | 150 | G | G |
| 6 | 120 | 140 | 180 | G | G |
| 7 | 120 | 180 | 180 | G | G |
| 8 | 120 | 200 | 180 | G | G |
| 9 | 150 | 230 | 225 | G | G |
| 10 | 160 | 250 | 240 | G | G |
| 11 | 180 | 270 | 270 | G | G |

TABLE 1-continued

| Test materials | Porosity of non-compressed portion ($inch^{-1}$) | Porosity adjacent discharge port ($inch^{-1}$) | Porosity of portion between walls ($inch^{-1}$) | Property of porous material: Supply responsivity | Property of porous material: Durability |
|---|---|---|---|---|---|
| 12 | 200 | 270 | 300 | N | G |
| 13 | 200 | 290 | 300 | N | G |
| 14 | 200 | 310 | 300 | N | G |
| 15 | 210 | 320 | 315 | N | G |
| 16 | 220 | 350 | 330 | N | G |
| 17 | 240 | 400 | 360 | N | G |

As will be understood from Table 1, the quantity of pores (per inch) is preferably 135–270.

The description has been made as to the desirability of the provision of the porous material below the partition plates. On the other hand, it is preferable that the consideration is paid to the flow passage below the partition plate, as follows. If the cross-sectional area of the flow passage before being filled with the porous or fibrous material between adjacent ink chambers, is too large, the air can remain with the result that the once formed air path is not easily filled back with the ink. The porous material or the fibrous material which are available these days, are considered as an aggregate having various different capillary tubes, if seen microscopically. Therefore, if the cross-sectional area is too small, the difference appears as it is in the difference of the vacuum in the ink supply container. Therefore, the cross-sectional area is preferably approx. 1–100 $mm^2$. However, this is not limiting if the variation of the capillary tubes of the porous material or the fibrous materials are hardly observed.

Such an edge of the partition plate as being press-contacted to the porous material or the fibrous materials (aggregate) and the other portion enclosing the porous material may be flat surface or may be provided with small projections. As a further alternative, the surfaces may be roughened. By doing so, unintended movement of the porous material or the fibrous material pressed, can be avoided.

Figure 12:
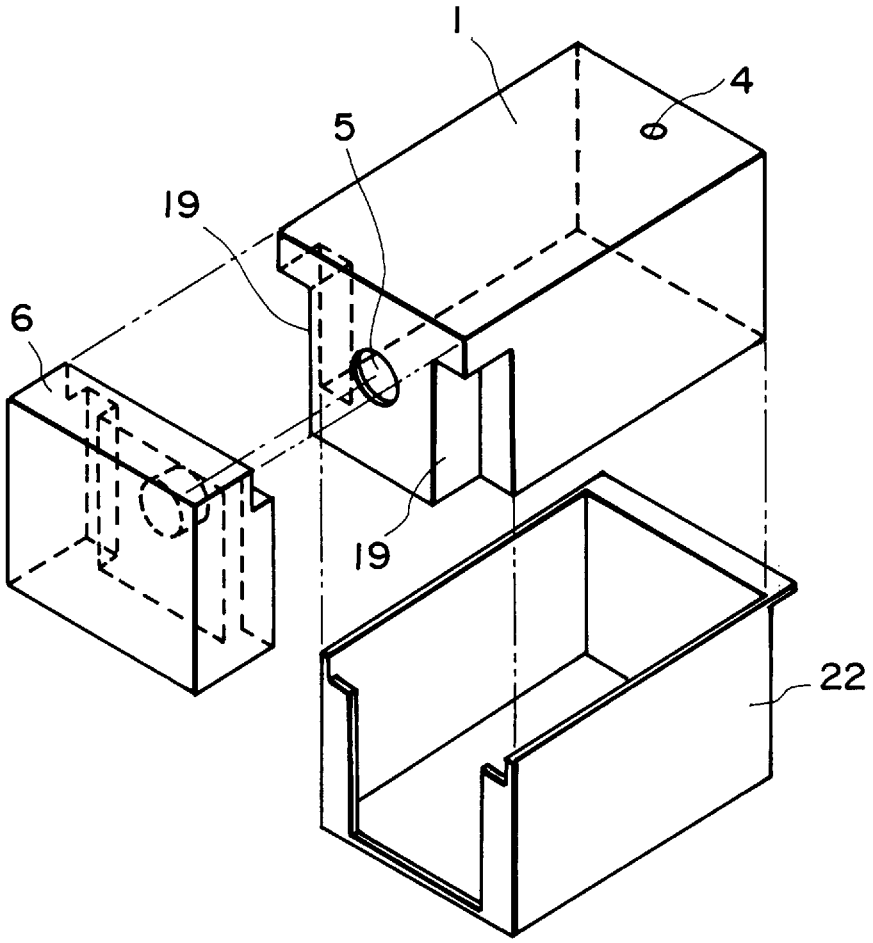
FIG. 12 is a perspective view of mounting means for mounting thereon a liquid container and a recording head.

Referring to FIG. 12, the description will be made as to the mounting means for mounting the liquid container according to this invention and the position or orientation confining means. In this FIG., the liquid container of this invention is indicated by a reference numeral 1. It comprises an air vent 4, a supply port 5 and an operating position confining or regulating portion 19. The internal structure of the container is as disclosed in each of the above-described embodiments. An element 6 receives the liquid from the liquid container through the supply port 5. When the liquid container is used as an ink container, the element 6 is a recording head. In the following description, the recording head will be taken. The recording head is provided with positioning means for regulating the position of the liquid container. Mounting means 22 is also provided with positioning rail means that cooperates with regulating means 19 for correctly positioning the liquid container.

As described in the foregoing, the liquid container of this invention is operable in almost any orientation of the container, but for the purpose of most stable liquid supply, the liquid supply material is preferably at the bottom. In order to assure such positioning, the positioning portions are effective. As shown in FIG. 12, the position or orientation of the liquid container may be determined by the cooperation between the positioning portion of the recording head and the positioning portion of the container. Otherwise, the positioning portion of the mounting means and the positioning portion of the container may be cooperatively used.

Figure 13:
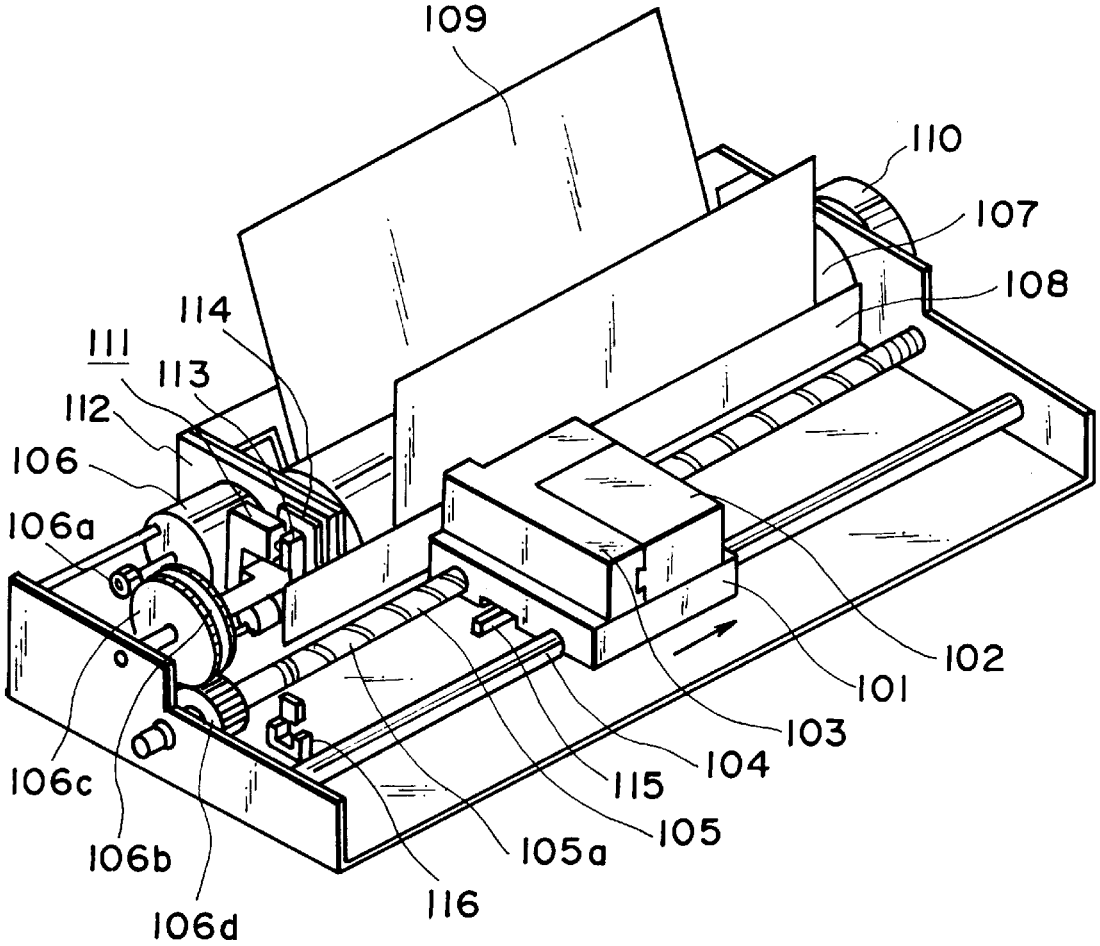
FIG. 13 is a perspective view of an ink jet recording apparatus mounting thereon a liquid container according to an embodiment of the present invention.
Figure 14:
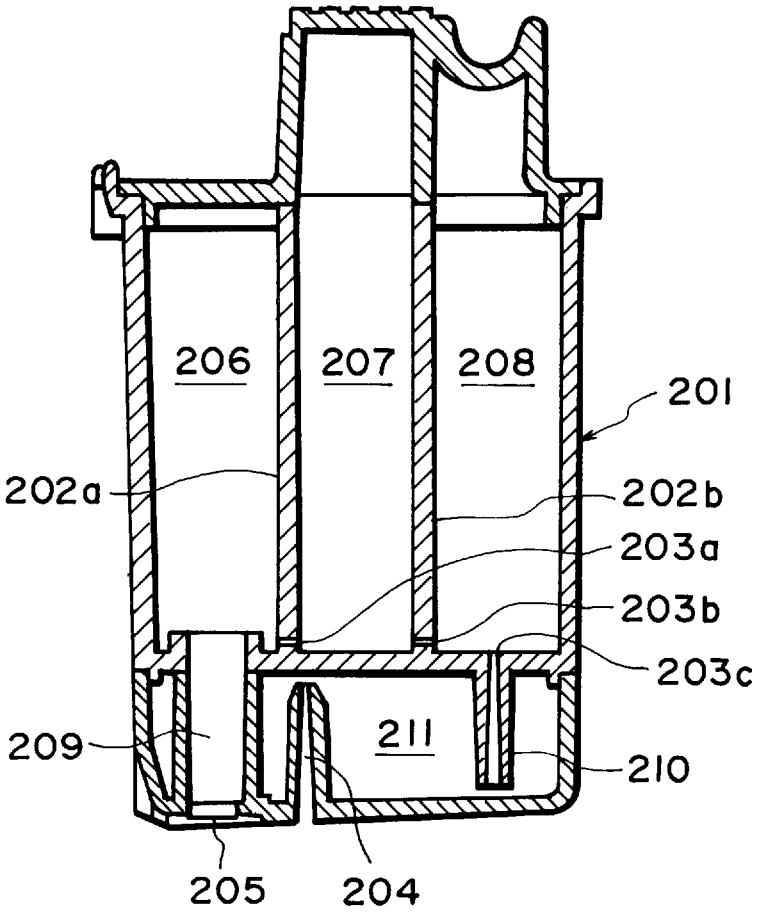
FIG. 14 is a sectional view of a further conventional liquid container
Figure 15:
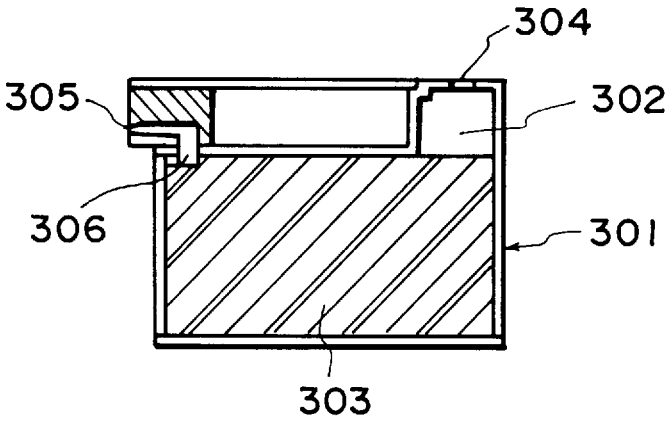
FIG. 15 is a sectional view of a conventional ink container.
Figure 16:
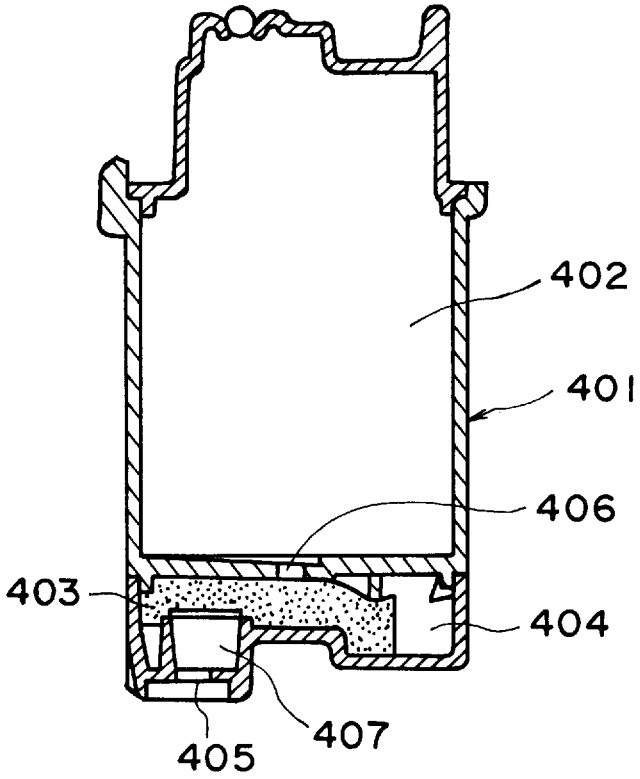
FIG. 16 is a sectional view of another conventional ink container.

Referring to FIG. 13, an ink jet recording apparatus using the ink container according to this invention, will be described.

The recording head and the ink container according to any one of the embodiments of the present invention are joined so as to constitute a recording head unit. The recording head unit is carried on a cartridge 101 which is guided by a guiding shaft 104 and a leak screw 105 having a helical groove 105*a*. In an alternative arrangement, the ink container according to this invention may be mountable to the recording head. The recording head 103 is provided with a pipe or rod not shown, and when the ink container cassette 102 is mounted, the pipe or rod is inserted into the discharge port of the container to open the supply port against the spring force of the spring to the ball.

The recording head is driven in response to a signal supply means in the recording apparatus.

The lead screw 105 is rotated in the forward and backward directions by a reversible motor 106 through gear trains 106*a*, 106*b*, 106*c* and 106*d*. The carriage 101 is reciprocated in the direction indicated by an arrow and in the opposite direction through an unshown pin of the cartridge 101, the end portion of the pin being in engagement with the helical groove 105*a*. The switching between the forward rotation and the backward rotation of the driving motor 106, is effected in response to detection of the home position of the carriage 101, which is detected by a combination of a lever 115 of the cartridge 101 and a photocoupler 116.

The recording material in the form of a sheet of paper 109 is contacted to a platen 107 by a confining plate 108, and is faced to the recording head by an unshown sheet feeding roller driven by a sheet feeding motor 110.

A recovery unit 111 functions to remove foreign matter deposited on the ejection outlet side of the recording head 103 or viscosity increased ink thereon so as to recover the regular ejection performance.

The recovery unit 111 comprises a capping member 113 in communication with an unshown sucking means and sucks the ink through the ejection outlets of the recording head 103 which is capped to remove the foreign matter and the viscosity-increased ink from the neighborhood of the ejection outlets. Between the recovery unit 111 and the platen 107, there is provided a cleaning blade which is movable toward and away from the movement path of the ejection outlet side of the recording head 103, along a guiding member 112. A free end of the cleaning blade 114 is effective to remove the foreign matter and ink droplets deposited on the ejection outlet side surface of the recording head.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Patent No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the mountable recording head, it may be a single head corresponding to a single color ink, or may be plural heads corresponding to a plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to the present invention, the plural chambers communicate with each other only through a continuous liquid supply material, and therefore, the latitude of the workable position of the liquid container is high without ink leakage due to the ambient condition change or due to the position change. The ink supply is stabilized, and the ink capacity is large as compared with the size of the container, and therefore, the size of the ink container can be reduced.

In addition, the liquid supply material functions also as a filter, and therefore, the flow passage is protected from clogging.

Using the container of this invention, a small size recording apparatus can be provided with stable recording operation. The liquid container can be produced without difficulty, because precision machining (drilling or the like) is not required.

While the invention has been described with reference to the structures disclosed herein, it is not confined to the details set forth and this application is intended to cover such modifications or changes as may come within the purposes of the improvements or the scope of the following claims.

What is claimed is:

1. A liquid container for containing liquid, said container comprising:

a first chamber for containing the liquid, said first chamber having a liquid supply port for supplying the liquid from said container and an air vent communicating with ambient air;

a second chamber;

a communication port for fluid communication between said first chamber and said second chamber only through said communication port; and an integral liquid absorbing material having a first portion existing in said first chamber and a second portion existing in said second chamber and a third portion which is between said first portion and said second portion and which exists in said communication port, wherein said liquid absorbing material is compressed more in the third portion than in portions adjacent said communication port of the first portion and the second portion.

2. A container according to claim 1, wherein said second chamber comprises a plurality of chambers disposed in series.

3. A container according to claim 1, wherein said container includes a main body of a material permitting observation of the liquid therein.

4. A container according to claims 1, 2 or 3, wherein said liquid absorbing material includes porous material or fibrous material.

5. A container according to claims 1 or 2, wherein said first chamber includes at least one of porous material and fibrous material.

6. A container according to claim 3, wherein said first chamber has a space always in fluid communication with said air vent, said space being in fluid communication with said liquid supply port only through said liquid absorbing material.

7. A container according to claim 1, further comprising a regulating portion for regulating a position of said container when it is mounted on a device using said container.

8. A recording head unit comprising:

a liquid container including a first chamber for containing the liquid, said first chamber having a liquid supply sort for supplying the liquid from said container and an air vent communicating with ambient air, a second chamber, a communication port for fluid communication between said first chamber and said second chamber only through said communication port, and an integral liquid absorbing material having a first portion existing in said first chamber and a second portion existing in said second chamber and a third portion which is between said first portion and said second portion and which exists in said communication port; and a recording head having energy generating means for generating energy to eject liquid supplied thereto from said liquid supply port, wherein said liquid absorbing material is compressed more in the third portion than in portions adjacent said communication tort of the first portion and the second portion.

9. A unit according to claim 8, wherein said second chamber comprises a plurality of chambers disposed in series.

10. A unit according to claim 8, wherein said container includes a main body of a material permitting observation of the liquid therein.

11. A unit according to claims 8, 9 or 10, wherein said liquid absorbing material includes porous material or fibrous material.

12. A unit according to claims 8 or 9, wherein said first chamber includes at least one of porous material and fibrous material.

13. A unit according to claim 8, further comprising a regulating portion for regulating a position of said container when it is mounted on a device using said recording head.

14. A recording apparatus comprising:

a liquid container including a first chamber for containing the liquid, said first chamber having a liquid supply port for supplying the liquid from said container and an air vent communicating with ambient air, a second chamber, a communication port for fluid communication between said first chaser and said second chamber only through said communication port, and an integral liquid absorbing material having a first portion existing in said first chamber and a second portion existing in said second chamber and a third portion which is between said first portion and said second portion and which exists in said communication port;

a recording head having energy generating means for generating ejection energy to eject liquid supplied thereto from said liquid supply port; and electric energy supply means for supplying electric energy to generate the ejection energy, wherein said liquid absorbing material is compressed more in the third portion than in portions adjacent said communication port of the first portion and the second portion.

15. An apparatus according to claim 14, further comprising a regulating portion for regulating a position of said container when it is mounted on said recording apparatus.

16. An apparatus according to claim 15, wherein said second chamber comprises a plurality of chambers disposed in series.

17. An apparatus according to claim 15, wherein said container includes a main body of a material permitting observation of the liquid therein.

18. An apparatus according to claims 15, 16 or 17, wherein said liquid absorbing material includes porous material or fibrous material.

19. An apparatus according to claims 15 or 16, wherein said first chamber includes at least one of porous material and fibrous material.

* * * * *

UNITED STATES PATENT AND TRADEMARK OFFICE

CERTIFICATE OF CORRECTION

PATENT NO. : 5,805,188

DATED : September 8, 1998

INVENTOR(S) : KAZUHIRO NAKAJIMA ET AL.

It is certified that error appears in the above-identified patent and that said Letters Patent is hereby corrected as shown below:

ON THE TITLE PAGE:

AT [56] REFERENCES CITED

U.S. PATENT DOCUMENTS

"4,463,359 7/1984 Avata et al." should read --"4,463,359 7/1984 Ayata et al.--.

COLUMN 2

Line 56, "as" should read --as to--.

COLUMN 3

Line 54, "provide" should read --provided--.

COLUMN 4

Line 4, "communicating" should read --communicating with--; and

Line 57, "container" should read --container.--.

UNITED STATES PATENT AND TRADEMARK OFFICE

CERTIFICATE OF CORRECTION

PATENT NO. : 5,805,188

DATED : September 8, 1998

INVENTOR(S) : KAZUHIRO NAKAJIMA ET AL.

It is certified that error appears in the above-identified patent and that said Letters Patent is hereby corrected as shown below:

COLUMN 5

Line 26, "communicates" should read --communicate--; and
Line 28, "id" should read --ld--.

COLUMN 6

Line 9, "althrough" should read --although--;
Line 39, "are" should read --is--; and
Line 47, "communicate" should read --communicates--.

COLUMN 7

Line 62, "a" should read --an--; and
Line 63, "the" (first occurrence) should read --to--.

COLUMN 8

Line 58, "atom)." should read --atm).--.

UNITED STATES PATENT AND TRADEMARK OFFICE

CERTIFICATE OF CORRECTION

PATENT NO. : 5,805,188

DATED : September 8, 1998

INVENTOR(S) : KAZUHIRO NAKAJIMA ET AL.

It is certified that error appears in the above-identified patent and that said Letters Patent is hereby corrected as shown below:

COLUMN 9

Line 8, "along" should read --along the--; and
Line 25, "materials" should read --material--.

COLUMN 10

Line 37, ""GG"," should read --"G",--;
Line 39, ""IN"." should read --"N".--; and
Line 46, ""IN"." should read --"N".--.

COLUMN 11

Line 23, "chambers," should read --chambers--; and
Line 25, "are" should read --is--.

COLUMN 12

Line 29, "discharge" should read --supply--; and
Line 30, "supply" should read --discharge--.

COLUMN 15

Line 17, "sort" should read --port--; and
Line 34, "tort" should read --port--.

UNITED STATES PATENT AND TRADEMARK OFFICE

CERTIFICATE OF CORRECTION

PATENT NO. : 5,805,188

DATED : September 8, 1998

INVENTOR(S) : KAZUHIRO NAKAJIMA ET AL.

It is certified that error appears in the above-identified patent and that said Letters Patent is hereby corrected as shown below:

COLUMN 16

Line 12, "chaser" should read --chamber--; and
Line 31, "claim 15," should read --claim 14,--.

Signed and Sealed this

Eleventh Day of July, 2000

*Attest:*

*Attesting Officer*

Q. TODD DICKINSON

*Director of Patents and Trademarks*